US005593573A

United States Patent [19]

Kramer

[11] Patent Number: 5,593,573

[45] Date of Patent: Jan. 14, 1997

[54] DEMETALATION OF HYDROCARBONACEOUS FEEDSTOCKS USING SULFURIC ACID AND SALTS THEREOF

[75] Inventor: David C. Kramer, San Anselmo, Calif.

[73] Assignee: Chevron Research Company, San Francisco, Calif.

[21] Appl. No.: 465,850

[22] Filed: Jun. 6, 1995

Related U.S. Application Data

[63] Continuation of Ser. No. 4,212, Jan. 13, 1993, abandoned, which is a continuation of Ser. No. 709,085, May 30, 1991, abandoned, which is a continuation of Ser. No. 222,472, Jul. 21, 1988, abandoned.

[51] Int. Cl.[6] ..... C10G 17/08; C10G 17/09

[52] U.S. Cl. ..... 208/252; 208/251 R

[58] Field of Search ..... 208/252, 251 R

[56] References Cited

U.S. PATENT DOCUMENTS

| | | | |
|---|---|---|---|
| 2,778,777 | 1/1957 | Powell | 196/40 |
| 3,622,505 | 12/1969 | Tilley | 208/252 |
| 4,645,589 | 10/1985 | Krambeck et al. | 208/252 |
| 4,705,622 | 11/1987 | Siskin | 208/251 R |
| 4,980,433 | 1/1991 | Reynolds et al. | 208/251 R |

*Primary Examiner*—Helane Myers
*Attorney, Agent, or Firm*—T. J. Hadlock

[57] ABSTRACT

Sulfuric acids or salts thereof are used to remove metals, particularly organically-bound calcium, from hydrocarbonaceous feedstocks. An aqueous solution of the acid or its salts is used to extract the metals from the feedstock prior to processing.

20 Claims, No Drawings

DEMETALATION OF HYDROCARBONACEOUS FEEDSTOCKS USING SULFURIC ACID AND SALTS THEREOF

This application os a continuation of Ser. No. 08/004,212 Jan. 13/1993 now abandoned, which is a continuation of Ser. No. 07/709,085 May 30, 1991 now abandoned, which is a continuation of Ser. No. 07/222,472 Jul. 21, 1988 now abandoned.

BACKGROUND OF THE INVENTION

This invention relates to a process for the removal of metals, in particular organically-bound calcium, from metals-containing petroleum crudes or heavy hydrocarbonaceous residua using sulfuric acid or its salts, particularly ammonium sulfate, as a demetalating agent. A few, but increasingly important, petroleum crude feedstocks, residua, and deasphalted oil derived from them, contain levels of calcium or other Group IIA metals which render them difficult, if not impossible, to process using conventional refining techniques. The metals contaminants causing particular problems are in the form of organically-bound, non-porphrynic compounds. These species have been attributed to, among other sources, naturally-occurring calcium. One class of calcium compounds identified in particular is the respective naphthenates and their homologous series. These organometallic compounds are not separated from the feedstock by normal desalting processes, and in a conventional refining technique they can cause the very rapid deactivation of hydroprocessing catalysts. Feedstocks demonstrating objectionably high levels of organically-bound calcium compounds are relatively unique, and include crudes from China, such as Shengli No. 2, and a few from the San Joaquin Valley in California. The residuum from these crudes also contains undesirably high levels of calcium.

The problems presented by organic calcium in petroleum feedstocks and the necessity for their removal have only been recently appreciated, and the prior art contains few references specifically to their removal. Metals removal generally, however, has been addressed in the prior art, specifically for the removal of known metallic contaminants, such as nickel, vanadium, and/or copper, which are ordinarily found in feedstocks as porphyrins and asphaltenes.

In U.S. Pat. No. 3,153,623, Eldib et al, selected commercially available organic compounds of high dielectric strength were added to assist in a process basically encompassing the electrically-directed precipitation of metals. U.S. Pat. No. 4,439,345, Duke, discloses the use of carboxylic acids to demulsify by demetalation the middle phase emulsion of an enhanced oil recovery product. U.S. Pat. No. 4,645,589, Krambeck, et al. discloses a method for removing vanadium and nickel metal porphyrins from hydrocarbon oils using phosphoric acid and its salts. U.S. Pat. No. 2,778,777, Powell, teaches the use of relatively high concentrations of sulfuric acid for the removal of porphyrinic heavy metals, such as vanadium, nickel and iron. Powell also teaches the removal of inorganic metal salts of light metals, such as calcium, sodium, and magnesium, also using relatively high concentrations of sulfuric acid, and ordinary desalting technology.

In U.S. applications Ser. Nos. 901,341, now U.S. Pat. No. 4,778,589, 901,342 now U.S. Pat. No. 4,778,591, 901,343 now U.S. Pat. No. 4,789,463, 901,344 now U.S. Pat. No. 4,778,590, 901,345 now U.S. Pat. No. 4,778,592 and 164,597 now U.S. Pat. No. 4,853,109, commonly assigned to the assignee of the present invention, various agents including aminocarboxylic acids, hydoxocarboxylic acids, dibasic carboxylic acids, and carbonic acid, and their salts, are used in similar processes to remove non-porphyrin organometallic contaminants from hydrocarbonaceous feedstocks.

Japanese Patent Publication Sho 52-30284, Fushimi, teaches a method for removing various metals contaminants from crude oil using a combination of mineral acid, alkyl phosphate ester and an oxidant. Japanese Patent Publication Sho 47-22947 teaches a lower level of metals removal using a combination of alkyl phosphate esters and alkyl carboxylic acid in the presence of mineral acids.

U.S. Pat. No. 4,432,865, Norman, teaches a process for treating used motor oil to remove metals using a polyhydroxy compound and a polyfunctional mineral acid.

Among other factors, it has now been unexpectedly found that organically-bound Group IIA metal contaminants, particularly those containing calcium, which are not separated using ordinary desalter technology, may be effectively removed from hydrocarbon feedstocks by mixing the metal compounds with a solution of sulfuric acid and/or its salts, particularly ammonium sulfate and ammonium bisulfate, and removing them from the feedstock by aqueous extraction and/or precipitation.

SUMMARY OF THE INVENTION

The invention comprises a method for demetalating hydrocarbonaceous feedstocks, particularly crude petroleum or residua, using an aqueous solution of sulfuric acid or a salt thereof. The method is particularly appropriate for removing calcium, especially non-porphyrin, non-asphaltinic, organically-bound calcium compounds. The preferred demetalating agents are sulfuric acid and salts thereof, particularly ammonium sulfate, in an aqueous solution. In the preferred process, the feedstock to be demetalized is intimately and thoroughly mixed with an aqueous solution of sulfuric acid or its salts. The metals interact with the demetalating agent, and the metals are extracted into the aqueous phase or less preferably, precipitated out of the liquids. The aqueous phase and/or the precipitate are separated from the hydrocarbon phase, and the hydrocarbonaceous feedstock is then available for further processing.

DETAILED DESCRIPTION OF THE INVENTION

Various petroleum crude oil feedstocks, and residua produced from them, contain unacceptably high levels of calcium-containing contaminants. These contaminants, especially organically-bound calcium-containing compounds cause distinct processing difficulties, especially in standard hydroprocessing techniques. In particular, they can rapidly deactivate or foul hydroprocessing catalysts, thereby reducing their effectiveness and overall process yield. This invention comprises a method for removing those metals-containing contaminants prior to processing of the crude or residua. This method uses a demetalating agent, comprising sulfuric acid and salts thereof, particularly ammonium sulfate or ammonium bisulfate.

The invention can be applied to any hydrocarbonaceous feedstock containing an unacceptably high level of organically-bound Group IIA metals, especially calcium. While relatively rare, these feedstocks include crude petroleum, especially from particular sources. Examples include some San Joaquin Valley crudes, including, for example, South Belridge, Kern Front, Cymric Heavy, Midway Sunset, or Shengli from China, or mixtures thereof. Additionally, gas oils, atmospheric or vacuum residua or solvent deasphalted oils derived from these crudes can also have unacceptably high calcium levels. It is within the contemplation of the invention that any other hydrocarbonaceous feedstocks, such as shale oil, liquefied coal, beneficiated tar sand, etc., which may also contain similar metals contaminants, may be processed using this invention.

In the basic process, the crude, residuum or deasphalted oil to be processed is mixed with an aqueous solution of sulfuric acid or its salts, and a base, preferably ammonia or ammonium hydroxide, is added to adjust the pH above 2, in order for the calcium to interact appropriately with sulfuric acid. Also, in the absence of base, corrosion and emulsion formation may cause difficulties. However, the addition of base may also cause the formation of emulsions. Therefore, a more preferred pH is a pH between 5 to 9, and even more preferably the mixture is adjusted to a relatively neutral solution, approximately pH 7,±1. As discussed above, ammonia or ammonium hydroxide are the preferred pH modifiers. Other amines are also contemplated as appropriate pH modifiers, though not preferred. These include alkyl, dialkyl, and trialkyl amines.

In an alternative embodiment, a solution of sulfuric acid and ammonia and/or ammonium hydroxide may be premixed prior to mixing with the feedstock. It is preferred that the proportions of the components be mixed such that the resulting solution of ammonium sulfate is at essentially neutral pH, i.e. pH 7,±1.

The Group IIA metal, preferably calcium, reacts with the demetalating agent, and is readily removed from the hydrocarbonaceous phase to the aqueous phase. This forms a complex which is ionic and generally water-soluble, and which can therefore be extracted easily into the aqueous phase of the mixture. After sufficient contacting to attain substantial metals removal, the two phases are separated or permitted to separate. While sulfuric acid and its salts may form compounds with other metal ions in aqueous solution, it appears to have little or no effect on the more commonly found, ordinary metal contaminants in petroleum, such as nickel and vanadium petroporphyrins and asphaltenes.

The solubility of the metal complex can depend, however, on various factors such as the amount of water present, temperature, pressure, etc. To maximize solubility of the compound or complex, while still maintaining an appropriate amount of water to minimize handling difficulties, the water to oil ratio is preferably maintained between about 2% to 10% by volume, more preferably 2% to 6%, and most preferably about 5%.

It is also possible, though not preferred, that some of the metal complex may precipitate during the mixing stage, and therefore need to be removed as solids. While this presents additional handling difficulties, it may be handled in a conventional separation manner, preferably also using a conventional desalter. Also, to help further minimize or eliminate precipitate formation, a precipitate inhibitor can be added. Preferred inhibitors include organic phosphonic acid salts, most preferably ethylene-diaminetetra (methylene phosphonic acid), (EDTMP), hydroxyethylidene diphosphonic acid (HEDP), tris-(aminomethylene) phosphonic acid (AMP) and their salts. Other agents which may be useful include amino carboxylates and polyacrylic amides. Some known sequestering agents, such as acetic acid, may also be useful. Typical amounts of preferred inhibitors finding use in the process would be approximately 1 to 1000 ppm inhibitor per 1000 ppm calcium, preferably 1 to 100 ppm.

The contact time between the aqueous extraction solution and the hydrocarbonaceous feed is important; longer contact times lead generally to higher metals removal. However, the economics of the process ordinarily limit contact times, which may vary from between one seconds or less to about 4 hours. In a continuous desalter, the preferred contact time is from about one second or less to 1 hour, and most preferred, about one second or less to about one minute.

Once separated, the aqueous solution, containing the removed metal contaminant, is typically discarded. The substantially metals-free, or at least metals-reduced, hydrocarbon feed can then be handled in the same manner as any other carbonaceous feed and processed by conventional hydroprocessing techniques. The amount of metals which are ordinarily removed is a function of the amount of demetalating agent, but is at least 10%, and preferably greater than 50%, more preferably greater than 60%.

It is contemplated that physically separating the two phases is ordinarily to be done in a conventional crude desalter, which is used for desalting petroleum crudes prior to processing. The separation may be done by any separation process, however, and may include, for example, countercurrent extraction.

The ratio of demetalating agent to feedstock to be demetalated is an important process parameter. Prior art processes (i.e. Powell) have utilized significantly higher concentrations of sulfuric acid to effect heavy metal porphryin removal. This higher concentration poses serious problems in terms of corrosion, materials handling, and economics and has not been demonstrated as effective in removing the previously-described metals contaminants. Conversely, it is also known to use very minor amounts of acid, relative to feed, as a facilitator of desalter operations. The present invention is intended to demetalate specific compounds which are not affected by the desalter, however, and the amount of acid relative to the feed is extremely minor. The preferred weight ratio of demetalating agent to feedstock in the present invention is between about 0.00001 units (10 ppm) to 0.015 (15,000) units per unit of feed.

The appropriate amount of demetalating agent may also be determined as a function of the amount of metal contaminants in the feedstock. Taking calcium as an example of the metal and sulfuric acid as the demetalating agent, the preferred ratio range of agent to metal is 0.5 moles acid per mole calcium, calculated as metal, to 10 moles acid per mole calcium, preferably 1.0 to 3.0 moles acid per mole calcium.

The volume of aqueous sulfuric acid solution to hydrocarbonaceous feed can also vary. The determining factor is generally the separation method. Commercial desalters, for example, ordinarily run at 10% or less aqueous volume. Countercurrent extraction may also be used for separation. Effective separations have been done at 50% or more aqueous volume.

EXAMPLES

Example 1 Sulfuric Acid

In laboratory trials, the results of which are detailed in Table I below, 75 grams of desalted vacuum residuum feed containing 54 ppm Ca was dissolved in 75 grams of toluene to give a solution having a workable viscosity. This solution was mixed with 75 grams of an aqueous solution containing the stated amounts of sulfuric acid expressed as moles acid per mole calcium in the crude. The crude and sulfuric acid solution were poured into a glass vessel and a demulsifier, trade-named Treatolite L-1562, was added (about 1800 ppm). The vessel was heated to 180° F. and the contents were stirred for 20 minutes with an electric stirrer and were allowed to separate overnight. Centrifugation was required to complete the separation of the crude and aqueous phases. The toluene was removed from the oil phase by heating under vacuum. The results are shown in Table I below.

TABLE I

Calcium Removal from Vacuum Residuum Using Sulfuric Acid

| Example | Moles Acid per Mole Ca | ppm Acid in Crude | ppm Ca in Product | % Ca Removal |
|---|---|---|---|---|
| 1a | 0 | 0 | 49 | 9 |
| 1b | 3 | 397 | 8 | 85 |
| 1c | 6 | 794 | 7 | 87 |

Stirred 20 minutes, 180° F., VR:Toluene:acid solution= 1:1:1.

Example 2 Ammonium Sulfate

In laboratory trials, the results of which are detailed in Table II below, a procedure similar to Example 1 was followed. Here, however, before the sulfuric acid solution was mixed with the crude, concentrated ammonium hydroxide solution was added until the pH was between 6 and 7. This procedure was preferred because the oil and water phases separated quickly without centrifugation and a much smaller amount of demulsifier was required (18 ppm). Also, the aqueous solution was less corrosive. The results are shown in Table II below.

TABLE II

Calcium Removal from Vacuum Residuum Using Sulfuric Acid and Ammonium Hydroxide (Ammonium Sulfate)

| Example | Moles Acid per Mole Ca | ppm Acid in Crude | ppm Ca in Product | % Ca Removal |
|---|---|---|---|---|
| 2a | 0 | 0 | 49 | 9 |
| 2b | 3 | 397 | 7 | 87 |
| 2c | 3 | 397 | 11 | 80 |
| 2d | 6 | 794 | 4 | 93 |
| 2e | 6 | 794 | 11 | 80 |
| 2f | 12 | 1,590 | 3 | 94 |
| 2g | 17 | 2,250 | 4 | 93 |
| 2h | 33 | 4,366 | 2 | 96 |
| 2i | 100 | 13,230 | 2 | 96 |

Stirred 20 minutes, 180° F., VR:Toluene:acid solution=1:1:1 Acid Solution Neutralized to pH 6–7 with $NH_4OH$ Solution.

Example 3 Continuous Calcium Removal

In tests in a two-stage crude oil desalter, calcium was removed continuously from about 54,000 BPD of crude containing 20–23 ppm Ca. An aqueous solution of sulfuric acid and ammonia was prepared in a large tank. The pH of the solution was 9.0. The solution was pumped into the inlet water line to the second stage of the desalter where it mixed with more fresh water. The operating conditions and the amounts of acid and ammonia injected are shown in Table III. A small amount of a precipitate inhibitor (EDTMP) was also injected into the fresh water to prevent precipitation of solids which may form in the process. The oil/water weight ratio was maintained above 30 and the temperature was maintained above 250° F. The aqueous phase containing the sulfuric acid and ammonia was mixed with the crude in the usual way by passing through static mixers. Samples of the oil and water phases from the second stage were taken after they separated in the desalter vessel. The oil phase was filtered and analyzed. The results are shown in Table III.

TABLE III

Calcium Removal from Crude During Crude Desalting Using Sulfuric Acid and Ammonia (Ammonium Sulfate)

| | TEST 1 | TEST 2 | TEST 3 |
|---|---|---|---|
| Crude Rate (BPD) | 51,000 | 54,000 | 53,000 |
| Desalter Temperature (F) | 284 | 284 | 266 |
| Desalter Pressure (PSIG) | 107 | 85 | 71 |
| Estimated Residence Time in Static Mixers (seconds) | 2 | 2 | 2 |
| INJECTION RATES: | | | |
| Fresh Water (GPH) | 1,350 | 2,050 | 2,200 |
| EDTMP** (lb/hr) | 0 | 4 | 4 |
| Additive Solution | | | |
| Water (lb/hr) | 0 | 5,657 | 2,950 |
| Acid (lb/hr) | 0 | 224 | 60 |
| Ammonia (estimated lb/hr) | 0 | 78 | 21 |
| pH | — | 9 | 9 |
| Analytical Results: | | | |
| Ca in Crude Feed (ppm) | 18 | 20 | 23 |
| Moles Acid Per Mole Ca in Feed | 0 | 6.4 | 1.5 |
| LB Acid per LB Crude Feed (ppm) | 0 | 314 | 85 |
| Ca in Desalted Crude (ppm) | 19 | 5 | 8 |
| Ca in Effluent Water (ppm) | 0 | 332 | 311 |
| % Ca Removal | 0 | 75 | 65 |
| Fe in Crude Feed (ppm) | 72* | 8 | 12 |
| Fe in Desalted Crude (ppm) | 17* | 6 | 7 |
| % Fe Removal | 76* | 25 | 42 |
| Ni in Crude Feed (ppm) | 23 | 20 | 21 |
| Ni in Desalted Crude (ppm) | 22 | 20 | 20 |
| % Ni Removal | 4 | 0 | 5 |
| V in Crude Feed (ppm) | 2 | 2 | 2 |
| V in Desalted Crude (ppm) | 2 | 2 | 2 |
| % V Removal | 0 | 0 | 0 |

**EDTMP = ethylenediaminetetra(methylenephosphonic acid)
*Suspected high result due to contamination with rust particles Comparing Test 1, without demetalating agent, to Tests 2 and 3, using demetalating agent, demonstrates clearly that ordinary desalting does not remove significant organically-bound calcium, while the claimed process does.

What is claimed is:

1. A method for removing organically-bound, Group IIA metals from hydrocarbonaceous feedstock comprising:

mixing said hydrocarbonaceous feedstock with an aqueous solution of a demetalating agent, said agent comprising sulfuric acid or salts thereof in a weight ratio range of 0.00001 units to 0.015 units demetalating agent per unit of feedstock and, separating the substantially demetalated hydrocarbonaceous feedstock from the aqueous solution.

2. A method for removing organically-bound, Group IIA metals from hydrocarbonaceous feedstock comprising:

mixing said hydrocarbonaceous feedstock with an aqueous solution of a demetalating agent, said agent comprising sulfuric acid or salts thereof in a molar ratio range of 0.5 moles demetalating agent per mole of metal to 10.0 moles demetalating agent per mole of metal and, separating the substantially demetalated hydrocarbonaceous feedstock from the aqueous solution.

3. A method for removing organically-bound, Group IIA metals from hydrocarbonaceous feedstock comprising:

preparing an aqueous solution of demetalating agent having a pH between about 6 and 8 by mixing sulfuric acid and ammonia or ammonium hydroxide;

mixing said hydrocarbonaceous feedstock with said demetalating agent solution in a weight ratio range of 0.00001 units to 0.015 units demetalating agent per unit of feedstock, and, separating the substantially demetalated hydrocarbonaceous feedstock from the aqueous solution.

4. A method for removing organically-bound, Group IIA metals from hydrocarbonaceous feedstock comprising:

preparing an aqueous solution of demetalating agent having a pH between about 6 and 8 by mixing sulfuric acid and ammonia or ammonium hydroxide;

mixing said hydrocarbonaceous feedstock with said demetalating agent solution in a molar ratio range of 0.5 moles demetalating agent per mole of metal to 10.0 moles demetalating agent per mole of metal and, separating the substantially demetalated hydrocarbonaceous feedstock from the aqueous solution.

5. The method as claimed in claims 1, 2, 3, or 4, wherein said Group IIA metal is calcium.

6. The method as claimed in claims 1 or 2, wherein the pH of the mixing step is adjusted to 2 or above.

7. The method as claimed in claim 6, wherein the pH of the mixing step is adjusted to 5 or above.

8. The method as claimed in claim 6, wherein the pH is adjusted using ammonia or ammonium hydroxide.

9. The method as claimed in claims 1, 2, 3, or 4, wherein the mixing time is from about one second to about 4 hours.

10. The method as claimed in claim 9, wherein the mixing time is about one second to about 1 minute.

11. The method as claimed in claims 1, 2, 3, or 4, wherein said separating is performed by a desalting process or countercurrent extraction.

12. The method as claimed in claims 1, 2, 3, or 4, wherein at least 10% by weight of said metals in said feedstock are demetalated.

13. The method as claimed in claim 12, wherein at least 50% of said metals are demetalated.

14. The method as claimed in claim 13, wherein at least 60% of said metals are demetalated.

15. The method as claimed in claims 1, 2, 3, or 4, wherein some of the metals to be demetalated from said feedstock form a precipitate which is separated from the aqueous solution and the feedstock.

16. The method as claimed in claims 1, 2, 3, or 4, wherein a precipitation inhibitor is included with the aqueous solution of said demetalating agent.

17. The method as claimed in claim 16, wherein said precipitation inhibitor is an organic phosphonic acid or its salt.

18. The method as claimed in claim 17, wherein said precipitation inhibitor is selected from the group consisting of ethylenediaminetetra(methylene phosphonic acid) hydroxyethylidene diphosphonic acid, tris-aminomethylene phosphonic acid, and salts thereof.

19. The method as claimed in claims 1, 2, 3 or 4, wherein the hydrocarbonaceous feedstock is selected from the group consisting of:

crude petroleum, atmospheric or vacuum residua, gas oils, deasphalted oils from such feedstocks, shale oil, liquefied coal, and tar sand effluent.

20. The method as claimed in claims 1 or 2, wherein the salts of sulfuric acid comprise ammonium sulfate or ammonium bisulfate.

* * * * *